US012179245B2

(12) United States Patent
Jeong et al.

(10) Patent No.: US 12,179,245 B2
(45) Date of Patent: Dec. 31, 2024

(54) APPARATUS FOR COOLING STEEL SHEET

(71) Applicant: POSCO, Pohang-si (KR)

(72) Inventors: Hae-Kwon Jeong, Pohang-si (KR); Jae-Hwa Lee, Pohang-si (KR); Won-Suk Choi, Pohang-si (KR); Kyo-Ha Joo, Pohang-si (KR); Sang-Won Lee, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 762 days.

(21) Appl. No.: 17/295,260

(22) PCT Filed: Jun. 11, 2019

(86) PCT No.: PCT/KR2019/007027
§ 371 (c)(1),
(2) Date: May 19, 2021

(87) PCT Pub. No.: WO2020/116734
PCT Pub. Date: Jun. 11, 2020

(65) Prior Publication Data

US 2022/0008977 A1 Jan. 13, 2022

(30) Foreign Application Priority Data

Dec. 7, 2018 (KR) ..... 10-2018-0157002

(51) Int. Cl.
*B21B 45/02* (2006.01)
*C23C 2/00* (2006.01)
(Continued)

(52) U.S. Cl.
CPC ..... *B21B 45/0233* (2013.01); *C23C 2/00344* (2022.08); *C23C 2/0035* (2022.08);
(Continued)

(58) Field of Classification Search
CPC ..... B21B 2045/0212; B21B 45/0233; C23C 2/00344; C23C 2/0035; C23C 2/0038;
(Continued)

(56) References Cited

U.S. PATENT DOCUMENTS 6,464,808 B2 * 10/2002 Pasquinet ..... C21D 9/573 148/657
7,381,364 B2 * 6/2008 Yamashita ..... C21D 9/573 266/113

(Continued)

FOREIGN PATENT DOCUMENTS

CN 2866518 2/2007
EP 3495515 6/2019

(Continued)

OTHER PUBLICATIONS

International Search Report—PCT/KR2019/007027 dated Sep. 17, 2019.

*Primary Examiner* — Jessee R Roe
*Assistant Examiner* — Michael Aboagye
(74) *Attorney, Agent, or Firm* — CANTOR COLBURN LLP

(57) ABSTRACT

An apparatus for cooling a steel sheet includes: an apparatus body provided spaced apart from a steel sheet in the conveying path of the steel sheet; and a cooling unit provided in the apparatus body to supply a cooling fluid. The apparatus body includes: a first edge body that faces a first edge portion extending a certain distance from one side end of the steel sheet toward the center of the steel sheet; and a second edge body that faces a second edge portion extending a certain distance from the other side end of the steel sheet toward the center of the steel sheet. The first and second edge bodies may have stepped cross-sections in a direction perpendicular to the conveying direction of the steel sheet.

18 Claims, 16 Drawing Sheets

(51) Int. Cl.
*C23C 2/26* (2006.01)
*C23C 2/28* (2006.01)

(52) U.S. Cl.
CPC ..... *C23C 2/0038* (2022.08); *C23C 2/004* (2022.08); *C23C 2/26* (2013.01); *C23C 2/29* (2022.08); *B21B 2045/0212* (2013.01)

(58) Field of Classification Search
CPC .. C23C 2/004; C23C 2/26; C23C 2/29; C23C 2/40; C23C 2/003; C23C 2/28
USPC ..... 266/44, 46, 259
See application file for complete search history.

(56) References Cited

U.S. PATENT DOCUMENTS

| | | | | |
|---|---|---|---|---|
| 7,968,046 | B2 | 6/2011 | Ebner et al. | |
| 8,771,588 | B2 * | 7/2014 | Langevin | C21D 1/667 266/251 |
| 10,233,527 | B2 * | 3/2019 | Kim | C23C 2/04 |
| 2004/0061265 | A1 | 4/2004 | Oogushi et al. | |
| 2007/0241485 | A1 | 10/2007 | Boyer et al. | |
| 2011/0042041 | A1 | 2/2011 | Zrodnikov et al. | |
| 2017/0002451 | A1 | 1/2017 | Kim et al. | |
| 2017/0211165 | A1 | 7/2017 | Nishizawa et al. | |
| 2019/0390316 | A1 | 12/2019 | Kim | |

FOREIGN PATENT DOCUMENTS

| | | |
|---|---|---|
| JP | H09194954 | 7/1997 |
| JP | 2012200728 | 10/2012 |
| KR | 20070068463 | 6/2007 |
| KR | 20100041275 | 4/2010 |
| KR | 20130075016 | 7/2013 |
| KR | 20150055261 | 5/2015 |
| KR | 20150066339 | 6/2015 |
| KR | 20150075328 | 7/2015 |
| KR | 20150089324 | 8/2015 |
| KR | 20170021310 | 2/2017 |
| KR | 101819386 | 1/2018 |
| KR | 101867682 | 6/2018 |
| WO | 2002081760 | 10/2002 |

* cited by examiner

| Case | Flat zone (Lc,mm) | Inclined Zone (Li,mm) | $\theta_1$ (deg) | Edge Flat Zone ($L_e$,mm) | Edge Inclined Zone ($L_{ei}$,mm) | $\theta_2$ (deg) | $\theta_3$ (deg) |
|---|---|---|---|---|---|---|---|
| 1 | 450 | 550 | 5.77 | 0 | 0 | 0 | 0 |
| 2 | 350 | 650 | 4.88 | 0 | 0 | 0 | 0 |
| 3 | 250 | 650 | 4.88 | 100 | 0 | 0 | 0 |
| 4 | 0 | 900 | 3.52 | 100 | 0 | 0 | 0 |
| 5 | 0 | 1000 | 3.16 | 0 | 0 | 0 | 0 |
| 6 | 450 | 0 | 0 | 550 | 0 | 0 | 0 |
| 7 | 0 | 900 | 3.52 | 50 | 50 | 3 | 0 |
| 8 | 450 | 450 | 0 | 50 | 50 | 3 | 3 |

APPARATUS FOR COOLING STEEL SHEET

TECHNICAL FIELD

The present disclosure relates to an apparatus for cooling a steel sheet.

BACKGROUND ART

When a surface of a steel sheet formed of aluminum or steel is plated with zinc or a zinc-alloy, a cooling process is performed to solidify a plated layer on the surface of the steel sheet.

Conventionally, such a cooling process may be performed during conveyance of a steel sheet to post-processing or during the post-processing. A period, in which such a cooling process is performed, may be significantly limited.

Therefore, water or air (hereinafter referred to as "cooling fluid") may be supplied to a steel sheet to perform strong cooling within an allowable cooling process period. In this case, a large amount of cooling fluid is used.

Since the cooling fluid colliding with the surface of the steel sheet is discharged along an edge of the steel sheet in a width direction, a flow rate of the cooling fluid tends to be increased in a direction toward the edge of the steel sheet. Due to the flow rate increased in the direction toward the edge of the steel sheet, surface defects such as a blowing mark may occur on the edge of the steel sheet.

DISCLOSURE

Technical Problem

An aspect of the present disclosure is to improve cooling efficiency of a steel sheet and to suppress occurrence of a defect on a surface of the steel sheet.

Another aspect of the present disclosure is to improve production efficiency of a steel sheet.

Technical Solution

The present disclosure relates to an apparatus for cooling a steel sheet.

An apparatus for cooling a steel sheet according to an example embodiment includes: an apparatus body provided to be spaced apart from a steel sheet in a conveying path of the steel sheet; and a cooling unit provided in the apparatus body to supply a cooling fluid. The apparatus body includes: a first edge body facing a first edge portion extending from one side end of the steel sheet by a predetermined distance in a center direction of the steel sheet; and a second edge body facing a second edge portion extending from the other end of the steel sheet by a predetermined distance in the center direction of the steel sheet. Each of the first and second edge bodies is provided such that a cross-section in a direction, perpendicular to a conveying direction of the steel sheet, is stepped.

Each of the first and second edge bodies may be provided such that a cross-section in a direction, perpendicular to the conveying direction of the steel sheet, is stepped in a width direction of the steel sheet, and a shortest distance to a surface of the steel sheet in a thickness direction of the steel sheet varies on a surface of each of the first and second edge bodies in the width direction of the steel sheet.

An apparatus for cooling a steel sheet according to an embodiment of the present disclosure includes: an apparatus body provided to be spaced apart from a steel sheet in a conveying path of the steel sheet; and a cooling unit provided in the apparatus body to supply a cooling fluid. The apparatus body includes: a first edge body facing a first edge portion extending from one side end of the steel sheet by a predetermined distance in a center direction of the steel sheet; and a second edge body facing a second edge portion extending from the other side end of the steel sheet by a predetermined distance in the center direction of the steel sheet. Each of the first and second edge bodies is provided such that a cross-section in a direction, perpendicular to a conveying direction of the steel sheet, is linearly inclined, and end portions of the first and second edge bodies are inclined in a direction away from the steel sheet to be present farthest from the steel sheet.

In the apparatus body, an absolute value of a plurality of first inclination angles, formed between an extension line of a symmetry point at which the first edge body and the second edge body intersect each other and the first and second edge bodies, may be 1° or more to 10° or less.

Each of the first and second edge bodies may include: a first inclined section forming the first inclination angle together with the symmetry point and being a region inclined in a direction away from the steel sheet; a non-inclined section, connected to the first inclined section, from which a shortest distance to the steel sheet in the thickness direction of the steel sheet is provided to be constant; and a second inclined section connected to the non-inclined section and being a region inclined in a direction toward the steel sheet.

The first and second edge bodies may be provided to form a second inclination angle in the second inclined section together with an extension line of the non-inclined section in the width direction of the steel sheet, and an absolute value of the second inclination angle may be at least 3°.

A length of the first inclined section in the width direction of the steel sheet may be at least 900 mm, a length of the non-inclined section in the width direction of the steel sheet may be at least 50 mm, and a length of the second inclined section in the width direction of the steel sheet may be at least 50 mm.

The apparatus body may include at least one dimple region formed to be concave on a surface, facing the steel sheet, in a direction opposing the steel sheet.

The first edge body and the second edge body may extend outwardly of an external circumference of the steel sheet in the width direction of the steel sheet.

The first and second edge bodies may be symmetrical with each other in the width direction of the steel sheet with respect to the symmetry point at which the first edge body and the second edge body intersect each other.

A diameter of the dimple region may be a value greater than 0 mm to 15 mm or less, a depth of the dimple region may be a value greater than 0 mm to 0.5 mm or less, and a maximum pitch of the dimple region may be 25 mm.

The cooling unit may include a plurality of cooling means spaced apart from each other in the conveying direction of the steel sheet in the apparatus body. The cooling means may include: a plurality of cooling nozzles facing the steel sheet to supply a cooling fluid; a slot accommodating the cooling nozzles therein; and a supply means connected to the cooling nozzles to supply the cooling fluid at constant pressure.

The apparatus body may further include a center body facing a center in a width direction of the steel sheet and present between the first edge body and the second edge body, and the center body may be provided such that a shortest distance to the steel sheet in the thickness direction of the steel sheet is provided to be constant in the width direction the steel sheet.

Each of the first edge body and the second edge body may include: a first inclined section facing the edge portion of the steel sheet and formed by providing an external circumference of the first inclined section so as to be inclined in a direction away from a surface of the steel sheet; a non-inclined section connected to the first inclined section and formed by providing an external circumference of the non-inclined section so as not to be inclined; and a second inclined section connected to the non-inclined section and formed by providing an external circumference of the second inclined section so as to be inclined in a direction toward the surface of the steel sheet.

A length of the non-inclined section in the width direction of the steel sheet may be greater than 0 and may be a certain value less than or equal to ⅕ of a total length of the center body in the width direction of the steel sheet.

The first and second inclined sections may be provided to be linearly inclined.

The apparatus body may include a plurality of partition walls disposed to be spaced apart from each other in the width direction of the steel sheet inside the apparatus body, and a spacing distance between the plurality of partition walls may at least equal to a length of the center body in the width direction of the steel sheet.

An absolute value of a third inclination angle, formed between an extension line of the center body and the first inclined section, may be a certain value between 1° or more to 5° or less.

A length of the second inclined section in the width direction of the steel sheet may be greater than 0, and may be a certain value within a range less than or equal to a length of the non-inclined section in the width direction of the steel sheet.

An absolute value of a second inclination angle, formed between an extension line of the non-inclined section in the width direction of the steel sheet and the second inclined section, may be greater than 0° and may be a value less than or equal to an absolute value of an inclination angle of the first inclined section.

The apparatus body may include a plurality of dimple regions formed to be concave on a surface, facing the steel sheet, in a direction opposing the steel sheet, and the plurality of dimple regions may be disposed in the width direction of the steel sheet.

The cooling unit may include a plurality of cooling means spaced apart from each other in the conveying direction of the steel sheet in the apparatus body. The cooling means may include: a plurality of cooling nozzles facing the steel sheet to supply a cooling fluid; a slot accommodating the cooling nozzles therein; and a supply means connected to the cooling nozzles to supply the cooling fluid at constant pressure. The plurality of cooling nozzles may be provided with a plurality of cooling nozzles in the width direction of the steel sheet in the apparatus body, and may be provided in the apparatus body to supply the cooling fluid in a position closer to the steel sheet than an external circumference of the apparatus body.

The plurality of cooling nozzles may be spaced apart from the steel sheet at regular intervals in the thickness direction of the steel sheet.

Advantageous Effects

As set forth above, cooling efficiency of a steel sheet may be improved, and surface quality of the steel sheet may be improved.

In addition, production efficiency of the steel sheet may be improved.

BEST MODE FOR INVENTION

Figure 1:
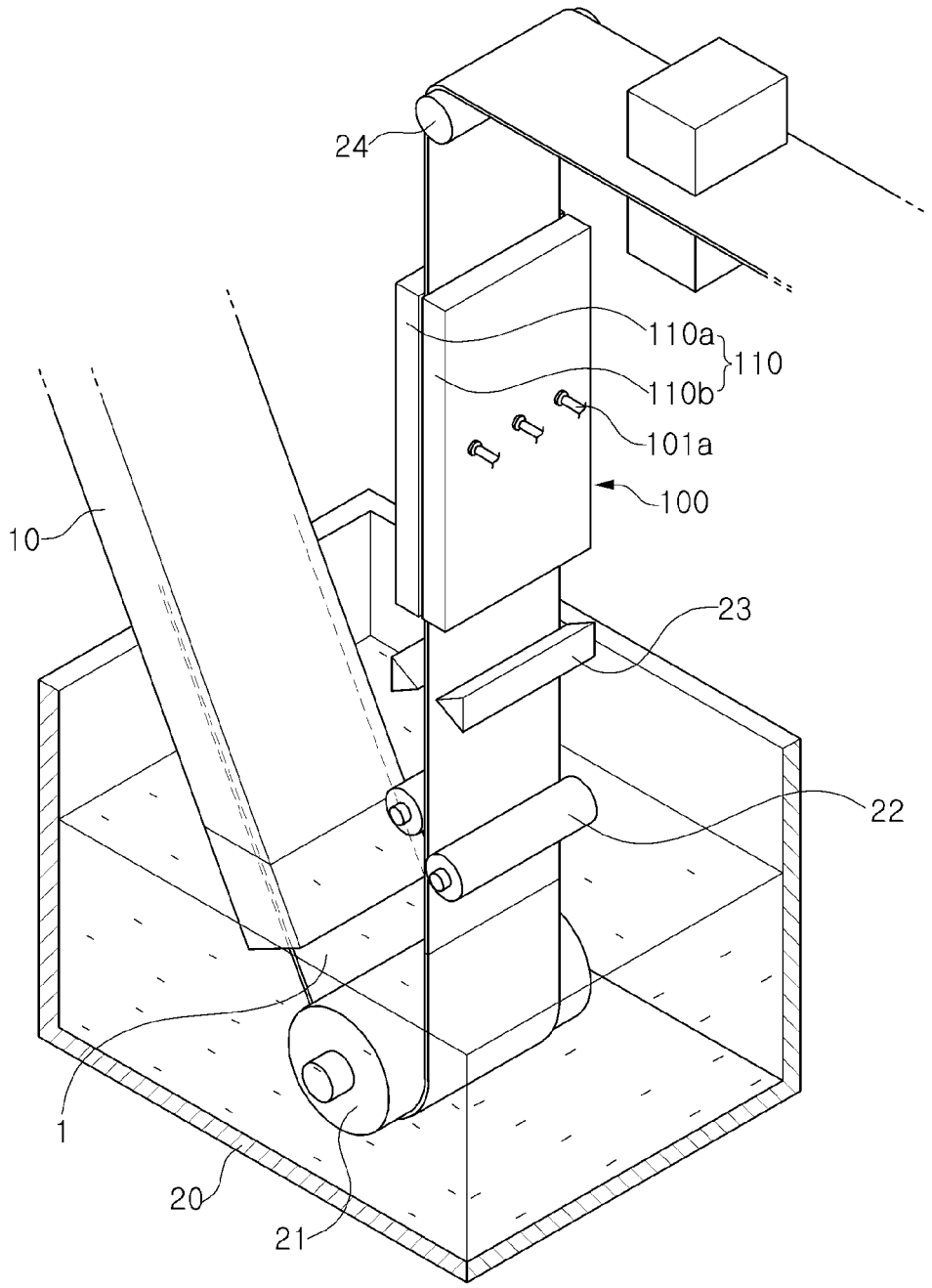
FIG. 1 is a schematic diagram of plating equipment to which an apparatus for cooling a steel sheet according to the present disclosure is applied.

In order to facilitate an understanding of the description of example embodiments of the present disclosure, the same reference numerals are used for the same elements in the accompanying drawings, and related elements among elements performing the same function in each example embodiment are denoted by the same number or the number of extension.

Further, in order to clarify the gist of the present disclosure, a description of elements and techniques well known in the related art will be omitted, and the present disclosure will be described in detail with reference to the accompanying drawings.

It is to be understood, however, that the spirit and scope of the present disclosure are not limited to the example embodiments illustrated, but other forms may be suggested by those skilled in the art while specific components are added, changed, and deleted, which also included within the scope of the same idea as the present disclosure.

In accompanying drawings, an X-axis refers to a thickness direction of a steel sheet, a Y-axis refers to a width direction of the steel sheet, and a Z-axis refers to a length direction of the steel sheet.

A cooling fluid to be described below may be at least one of water, air, and nitrogen. Alternatively, water, air, and nitrogen may be appropriately mixed to be used as the cooling fluid. The type of the cooling fluid may be appropriately selected and applied depending on characteristics of a steel sheet, characteristics of a plating process, and the like.

A steel sheet to be described below may be a galvanized steel sheet or a zinc-alloy plated steel sheet in which magnesium is contained in an amount of 1% or more.

The above-mentioned steel sheet may be a hot-rolled or cold-rolled steel sheet, and may have a width of 700 to 1800 mm.

A shortest distance from an injection port of a cooling nozzle for supplying a cooling fluid to the surface of the steel sheet may be 80 to 150 mm, and the cooling nozzle may be provided with a plurality of cooling nozzles in a width direction and a length direction of the steel sheet. In this case, the cooling nozzle may be spaced apart from the steel sheet by at least 200 mm in the width direction of the steel sheet.

In addition, the cooling nozzle may adopt various types such as a straight slit type, a round type, and the like.

Hereinafter, a unit of an angle is degrees (°).

As illustrated in FIG. 1, a heat-treated steel sheet 1 may be introduced into a plating bath 20 through a snout 10 of an annealing furnace, so that a direction of the steel sheet 1 may be changed by a sink roll 21. Then, the steel sheet 1 may be vertically guided by a guiding roll to be conveyed to an air knife 23.

The air knife 23 may supply a fluid at high speed to control a thickness of a plated layer. The steel sheet 1, passing through the air knife 23, may be provided to an apparatus 100 for cooling a steel sheet according to the present disclosure.

The steel sheet 1, in which a plated layer is cooled, solidified, and hardened while passing through the apparatus 100 for cooling a steel sheet, is conveyed to post-processing.

The apparatus 100 for cooling a steel sheet according to the present disclosure, disposed in plating equipment of a steel sheet, may include an apparatus body 110 facing the steel sheet 1. The apparatus body 110 may include a first apparatus body 110*a*, facing one side surface of the steel sheet 1, and a second apparatus body 110*b*, facing the other side surface of the steel sheet 1 to be spaced apart from the first apparatus body 110*a*.

A cooling fluid supply line 101*a* may be connected to the first apparatus body 110*a* and the second apparatus body 110*b*, and a cooling fluid may be continuously supplied to the first apparatus body 110*a* and the second apparatus body 110*b* through the cooling fluid supply line 101*a*.

A suction means, not illustrated, providing constant suction pressure to suction the supplied cooling fluid, may be connected to the first apparatus body 110*a* and the second apparatus body 110*b*. However, the present disclosure is not limited thereto, and the suction means may be appropriately selected and applied by those skilled in the art.

Figure 2:
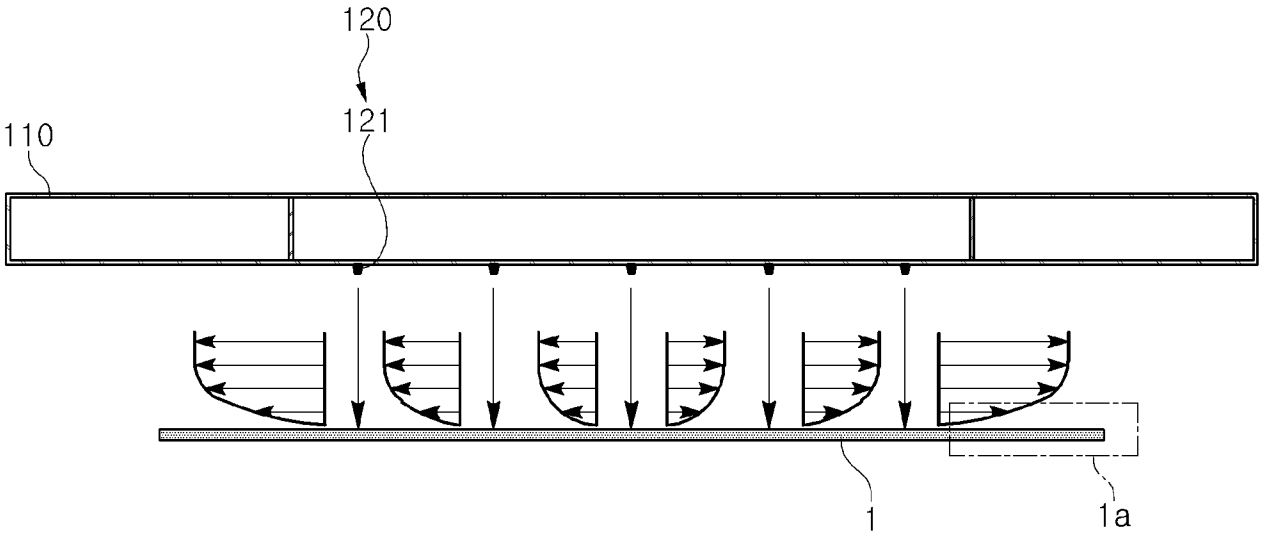
FIG. 2 is a schematic view illustrating a cooling flow rate of a steel sheet.

As illustrated in FIG. 2, a cooling means 120 for supplying the cooling fluid to the steel sheet 1 may be provided on a surface of the apparatus body 110 facing the steel sheet 1.

The cooling means 120 may include a plurality of cooling nozzles 121. The plurality of cooling nozzles 121 may be provided in the apparatus body 110 to be spaced apart from each other in the width direction of the steel sheet 1.

The cooling nozzle 121 may adopt a slit type, a round type, or the like, but the type of the cooling nozzle 121 is not limited by the present disclosure.

A flow rate of the cooling fluid, passing in the vicinity of the steel sheet 1, is increased in a direction toward the edge of the steel sheet 1. This is because the amount of the cooling fluid, passing in the vicinity of the steel sheet 1, is increased due to accumulation of the cooling fluid injected from the cooling nozzle 121.

Such an increased flow rate is a main cause of surface defects such as a blowing mark on a first edge portion 1*a*, one side edge of the steel sheet 1. The surface defects may also occur on the other side edge.

Figure 3:
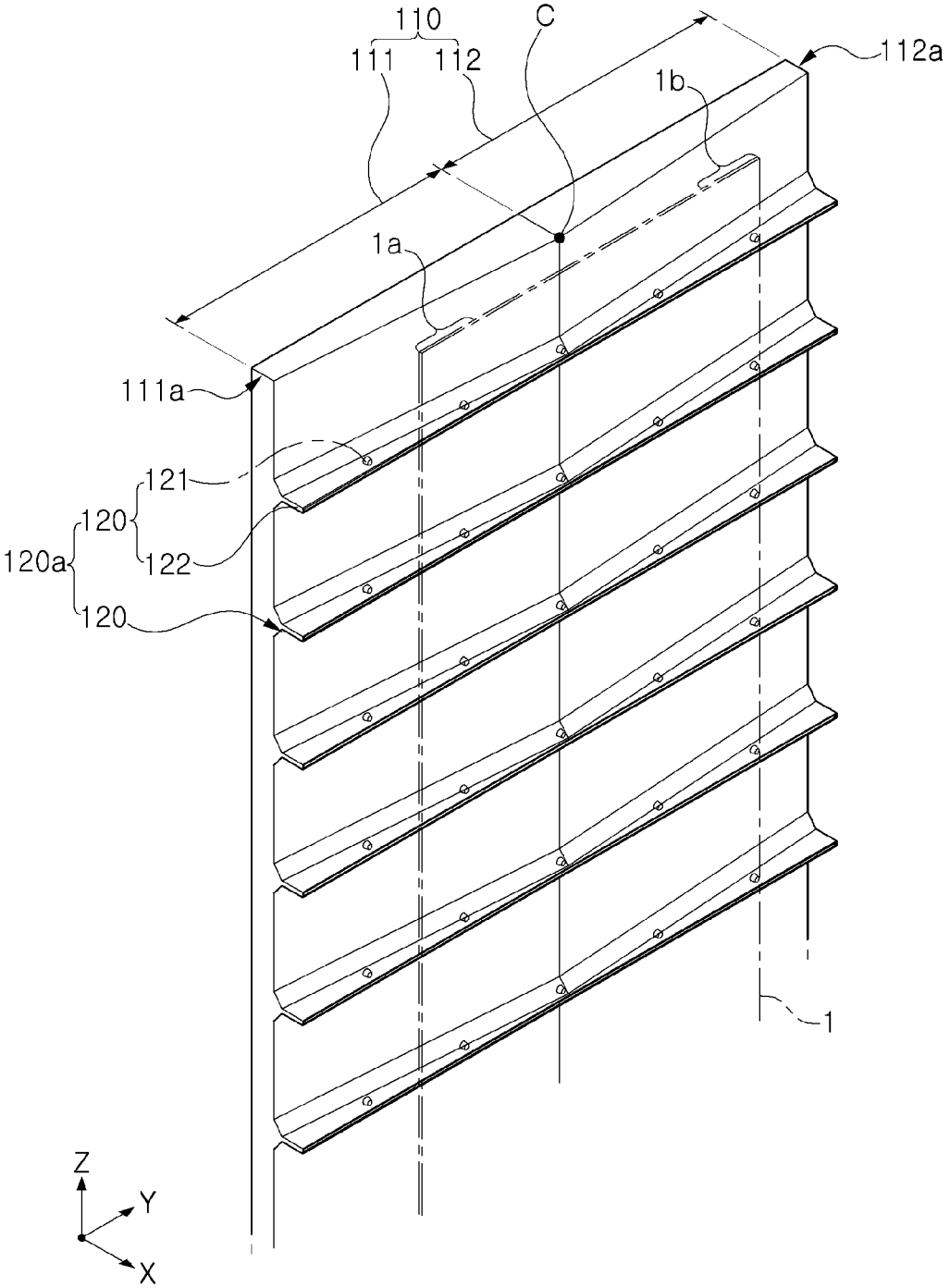
FIG. 3 is a schematic diagram of an apparatus for cooling a steel sheet according to an embodiment of the present disclosure.

Accordingly, as illustrated in FIG. 3, the apparatus for cooling a steel sheet according to the present disclosure may include a first edge body 111 and a second edge body 112. The first edge body 111 faces a first edge portion 1*a* extending from one side end of the steel plate by a predetermined distance in the center direction of the steel plate. The second edge body 112 faces a second edge portion 1*b* extending from the other end side end of the steel sheet by a predetermined distance in the center direction of the steel sheet.

In addition, each of the first and second edge bodies 111 and 112 may have a linearly inclined cross-section in a Z direction, for example, a direction perpendicular to a conveying direction of the steel sheet 1. In this case, an end portion of the first edge body 111 and an end portion 112*a* of the second edge body 112 may be provided to be inclined in a direction away from the steel such that the end portions 111*a* and 112*a* are present farthest from the steel in an X direction, for example, in a thickness direction of the steel sheet.

Accordingly, a spacing distance between the first edge body 111 and the second edge body 112, and the steel sheet 1 may be gradually increased to provide a wide space in which the cooling fluid is able to be discharged.

As a result, time for which the cooling fluid remains in the first edge portion 1*a* and the second edge portion 1*b* of the steel sheet may be reduced, and the amount of the cooling fluid remaining in the first edge portion 1*a* and the second edge portion 1*b* of the steel sheet may be reduced, so that surface defects of the steel sheet caused by the increased flow rate of the cooling fluid may be prevented.

In addition, even when the first edge body 111 and the second edge body 112 are not elongated in the width direction of the steel sheet 1, a wide space in which the cooling fluid is able to be discharged may be provided. Therefore, surface quality of the steel sheet may be improved without enlargement of equipment. Such an effect may be equivalently applied to the apparatus bodies 110 in other embodiments of the present disclosure to be described later.

The first and second edge bodies 111 and 112 may be symmetrical in the width direction of the steel sheet, for example, in a Y-axis direction, with respect to a symmetry point C at which the first edge body 111 and the second edge body 112 intersect each other.

In addition, a cooling means 120 may be provided on the surfaces of the first and second edge bodies 111 and 112. The cooling means 120 may include a plurality of cooling nozzles 121, disposed along a surface of the apparatus body 110 in the Y-axis direction, and a slot 122 accommodating the cooling nozzles 121 therein and opened in the direction of the steel sheet 1.

The cooling fluid, supplied from the cooling nozzle 121, may flow along the slot 122 to reach the surface of the steel sheet. The slot 122 may serve to increase supply pressure of the cooling fluid, allowing supply of the cooling fluid supplied from the cooling nozzle 121 to the steel sheet to be useful and reducing the amount of loss of the cooling fluid.

The cooling means 120 may be provided with a plurality of cooling means in the apparatus body 110 in the conveying direction of the steel sheet, for example, in a Z-axis direction, to constitute a cooling unit 120*a* on the apparatus body 110.

In this case, the plurality of cooling means 120 may be spaced apart from each other by a predetermined distance in the conveying direction of the steel sheet, for example, in the Z-axis direction.

The cooling nozzle 121 may be a slot (an open hole) formed in a surface of the apparatus body 110. The type and shape of the cooling nozzle 121 are not limited by the present disclosure.

Figure 4:
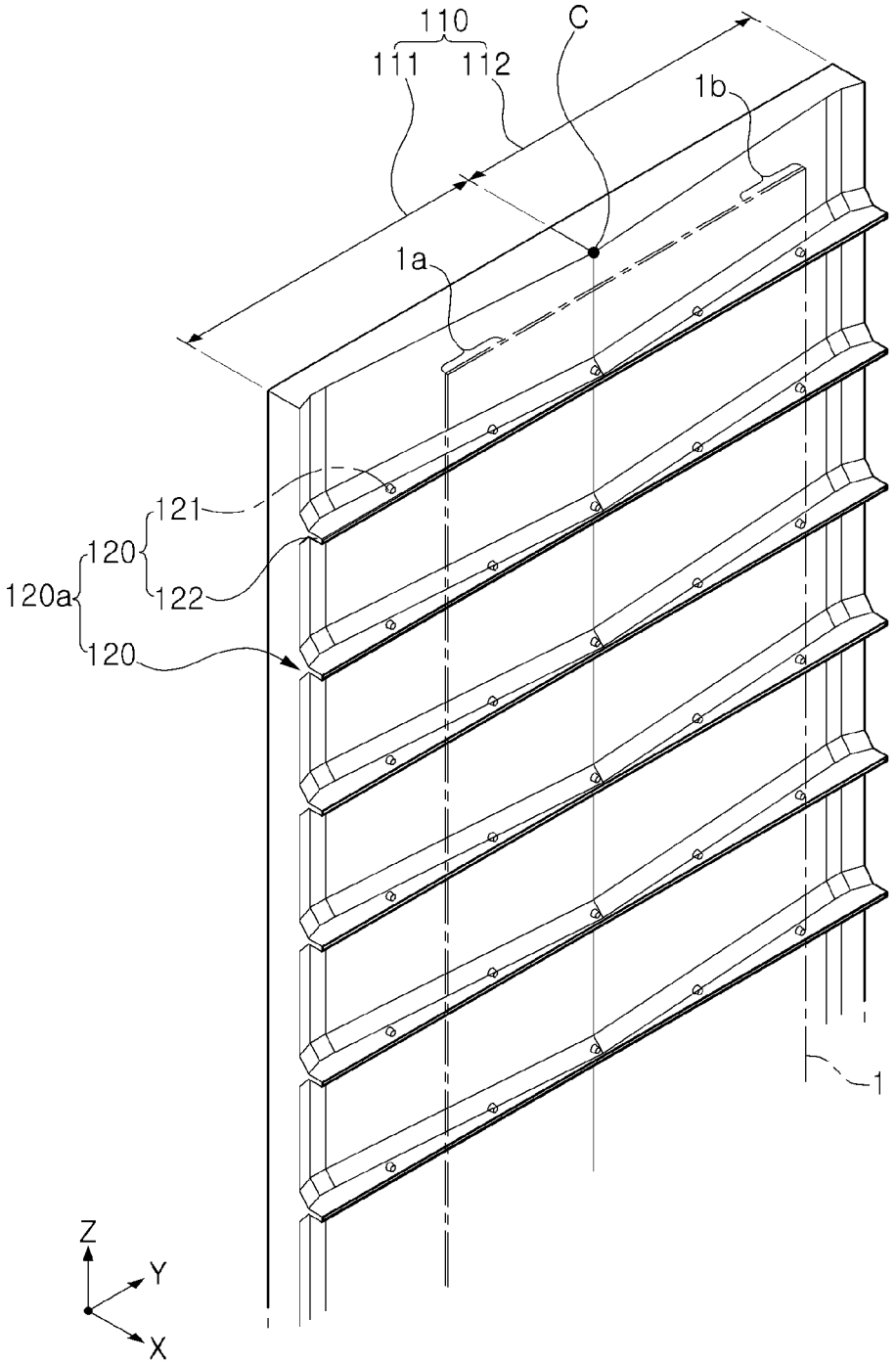
FIG. 4 is a schematic diagram of an apparatus for cooling a steel sheet according to another embodiment of the present disclosure.

As illustrated in FIG. 4, an apparatus for cooling a steel sheet may include a first edge body 111 and a second edge body 112. The first edge body 111 may face a first edge portion 1*a* extending from one side of the steel sheet 1 by a predetermined distance in a center direction of the steel sheet 1. The second edge body 112 facing a second edge portion 1*b* extending from the other side end of the steel sheet 1 by a predetermined distance in the center direction of the steel sheet 1.

In addition, a cross-section of the first edge body 111 and the second edge body 112, for example, a cross-section in an X-Y plane perpendicular to a Z-axis direction may be provided with a stepped edge.

The sentence "a cross-section in an X-Y plane perpendicular to a Z-axis direction may be provided with a stepped edge" means that a facing surface of the first and second edge bodies 111 and 112 and the steel sheet 1 may be nonlinear in a Y-axis direction.

As described above, the first edge body 111 and the second edge body 112 are provided with a nonlinear surface in the Y-axis direction, so that the nonlinear surface in the Y-axis direction of the apparatus body may face the steel sheet 1.

A cooling means 120 may be provided on the nonlinear surface of the apparatus body 110. The cooling means 120 may include a plurality of cooling nozzles 121, disposed along the nonlinear surface of the apparatus body in the Y-axis direction, a slot 122 accommodating the nozzles 121 therein opened in the direction of the steel sheet 1.

The cooling, fluid supplied from the cooling nozzle 121, may flows along the slot 122 to reach the surface of the steel sheet, and this slot 122 may serve to increase supply pressure of the cooling fluid, allowing supply of the cooling fluid supplied from the cooling nozzle 121 to the steel sheet to be useful and reducing the amount of loss of the cooling fluid.

The cooling means 120 may be provided with a plurality of cooling means in the apparatus body 110 in the conveying direction of the steel plate, for example, in a Z-axis direction, to constitute a cooling unit 120*a* on the apparatus body 110.

In this case, the plurality of cooling means 120 may be spaced apart from each other by a predetermined distance in the conveying direction of the steel plate, for example, in the z-axis direction.

The cooling nozzle 121 may be a slot (an open hole) formed in a surface of the apparatus body 110. The type and shape of the cooling nozzle 121 are not limited by the present disclosure.

Figure 5:
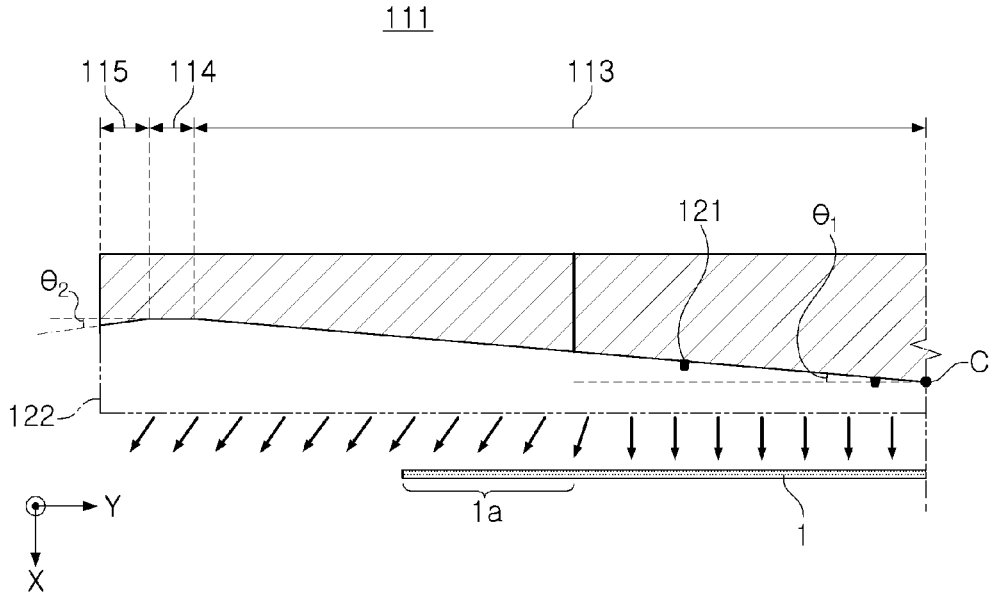
FIG. 5 is a diagram illustrating a cross-section of a first edge body.

As illustrated in FIG. 5, the first edge body 111 may have a shape symmetrical to the second edge body (112 in FIG. 4) with respect to a symmetry point C.

The first edge body 111 may have a cross-section in an X-Y plane perpendicular to a conveying direction of the steel sheet, for example, in the Y-axis direction, provided to be stepped in the Y-axis direction, and thus, a thickness of the first edge body 111 is not regular in the Y-axis direction.

For example, the first edge body 111 is provided such that a shortest distance from the surface of the first edge body 111 to the surface of the steel sheet in the X-axis direction is changed in the Y-axis.

Accordingly, the thickness of the first edge body 111 may be not constant in the Y-axis direction, and may be changed in the Y-axis direction.

An angle, formed between a surface facing the steel sheet 1 in the first edge body 111 and an extension line of the symmetry point C, is defined as a first inclination angle θ1. An absolute value of the first inclination angle θ1 is a certain value within the range of 1° or more to 10° or less.

The first edge body 111 may include a first inclined section 113 provided by forming the first inclination angle between an external circumference of the first edge body 111 and the symmetry point C, a non-inclined section 114 present farther than the first inclined section 113 in the width direction of the steel sheet 1 from the symmetry point C by connecting the external circumference of the first edge body 111 to the first inclined section 113, and a second inclined section 115 present farther than the non-inclined section 114 in the width direction of the steel sheet 1 from the symmetry point C by connecting the external circumference of the first edge body 111 to the non-inclined section 114.

For example, the first inclined section 113, the non-inclined section 114, and the second inclined section 115 may be referred to as regions formed by bending the external circumference of the first edge body 111, which is equivalently applies to the second edge body (112 in FIG. 4).

The first inclined section 113 may be a surface facing the first edge portion 1*a* of the steel sheet, and may continue to the outside of an end portion of the steel sheet.

The non-inclined section 114 may be a surface parallel to the surface of the steel sheet 1, and may be present outside the first edge portion 1*a* in the Y-axis direction. A thickness of the non-inclined section 114 in the X-axis direction may be constant without being changed in the Y-axis direction.

The second inclined section 115, connected to the non-inclined section 114 and having an end portion of the first edge body 111, may be provided to be inclined in a direction toward the surface of the steel sheet 1.

The second inclined section 115 may be a section inclined in a direction toward the surface of the steel sheet 1, and a thickness of the second inclined section 115 in the X-axis direction may be greater than or equal to a thickness of the non-inclined section 114 in the X-axis direction.

In this case, the thickness of the second inclined section 115 in the X-axis direction may be linearly changed in the Y-axis direction. An angle, formed between an extension line of the non-inclined section 114 in the Y-axis direction and the second inclined section 115, is defined as a second inclination angle θ2, and an absolute value of the second inclination angle θ2 may be at least 3°.

The second inclination angle θ2 may be present in the edge region of the first edge body 111. When the second inclined section 115 is provided to be inclined by the second inclination angle θ2, a flow rate of a cooling fluid may be increased and a pressure may be decreased immediately before the cooling fluid is discharged to the outside of the first edge body 111. Therefore, the cooling fluid may be rapidly discharged right before a cooling fluid discharge outlet of the first edge body 111.

Figure 8:
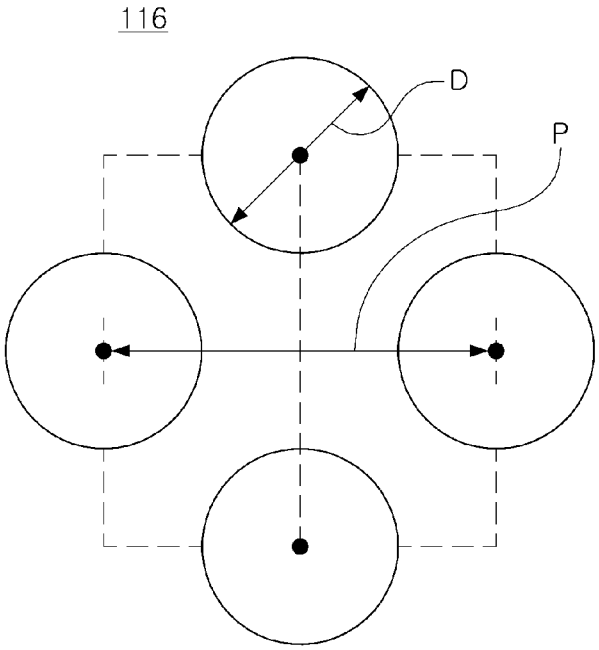
FIG. 8 is a schematic diagram of a dimple region.

This is equivalently applied to the second inclination angle θ2 formed on a second edge body (112 in FIG. 8).

In an embodiment of the present disclosure, a width direction of the steel sheet 1 of the first inclined section 113, for example, a length of a straight line of the first inclined section 113 in the Y-axis direction may be at least 900 mm, a length of a straight line of the non-inclined section 114 in the Y-axis direction may be at least 50 mm, and a length of a straight length of the steel sheet of the second inclined section 115 in the Y-axis direction may be at least 50 mm.

However, the thickness of the first edge body 111 in the X-axis direction may be appropriately adjusted such that each of the absolute values of the first inclination angle θ1 and the second inclination angle θ2 is within the above range. This will be equivalently applied to the case of the third inclination angle (θ3 in FIG. 12) to be described later.

The cooling nozzle 121 may be provided in a region corresponding to the first inclined section 113 of the first edge body 111, and may be provided in a region of the first inclined section 113, which does not face the first edge portion of the steel sheet 1, to supply the cooling fluid to the steel sheet 1.

In this case, when the slot 122 is provided in the first edge body 111 to accommodate the cooling nozzle 121, a supply pressure of the cooling fluid may be increased to prevent the cooling fluid from being excessively used.

Figure 6:
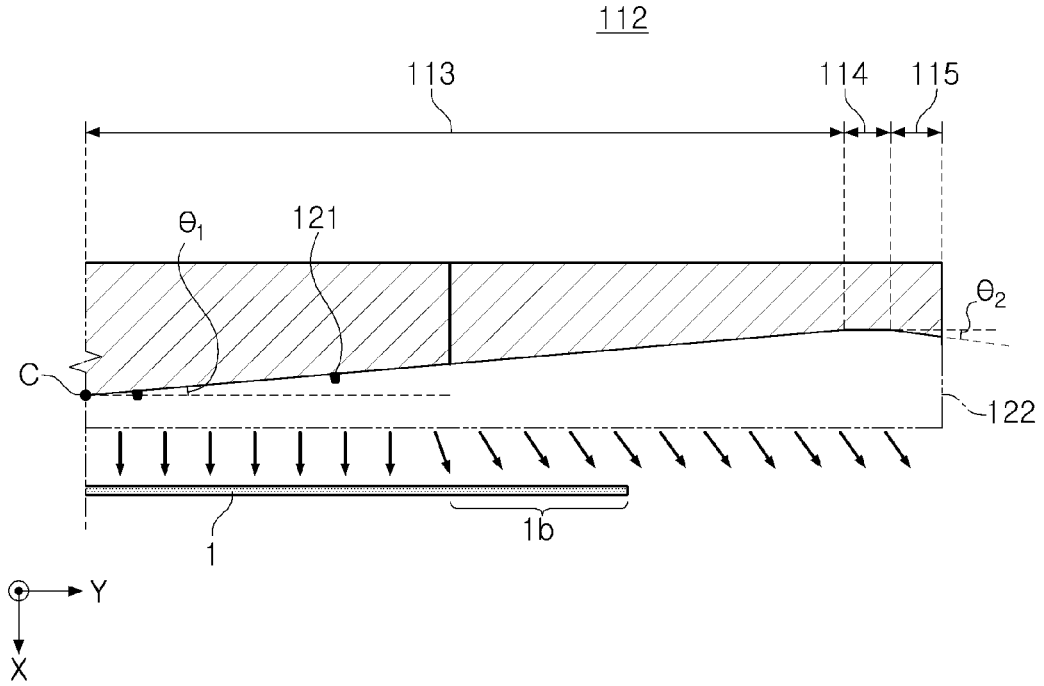
FIG. 6 is a diagram illustrating a cross-section of a second edge body.

As illustrated in FIG. 6, the second edge body 112 may be symmetrical to the first edge body (111 of FIG. 5) with respect to the symmetry point C in the width direction of the steel sheet 1.

Accordingly, the absolute value of the first inclination angle θ1 may be a certain value within the range of 1° or more to 10° or less, and the absolute value of the second inclination angle θ2 may be at least 3°.

The cooling nozzle 121 may be provided in a region of the first inclined section 113, which does not face the second edge portion of the steel sheet 1, to supply a cooling fluid to the steel sheet 1.

According to the first edge body (111 of FIG. 5) and the second edge body 112 described above, a spacing distance between the first edge body (111 of FIG. 5) and the second edge body 112, and the steel sheet 1 may be increased in a direction toward the first edge portion (1*a* of FIG. 5) extending from one end portion of the steel sheet by a predetermined distance in a center direction of the steel sheet, and a region corresponding to the second edge portion extending from the other end portion of the steel sheet by a predetermined distance in the center direction of the steel sheet. Therefore, a space in which the cooling fluid is able to be discharged may be widened to that extent.

As a result, time for which the cooling fluid remains in the first edge portion (1*a* of FIG. 5) and the second edge portion of the steel sheet may be reduced, and the amount of the cooling fluid remaining in the first edge portion (1*a* of FIG. 5) and the second edge portion of the steel sheet may be reduced, so that surface defects of the steel sheet caused by the increased flow rate of the cooling fluid may be prevented.

Figure 7:
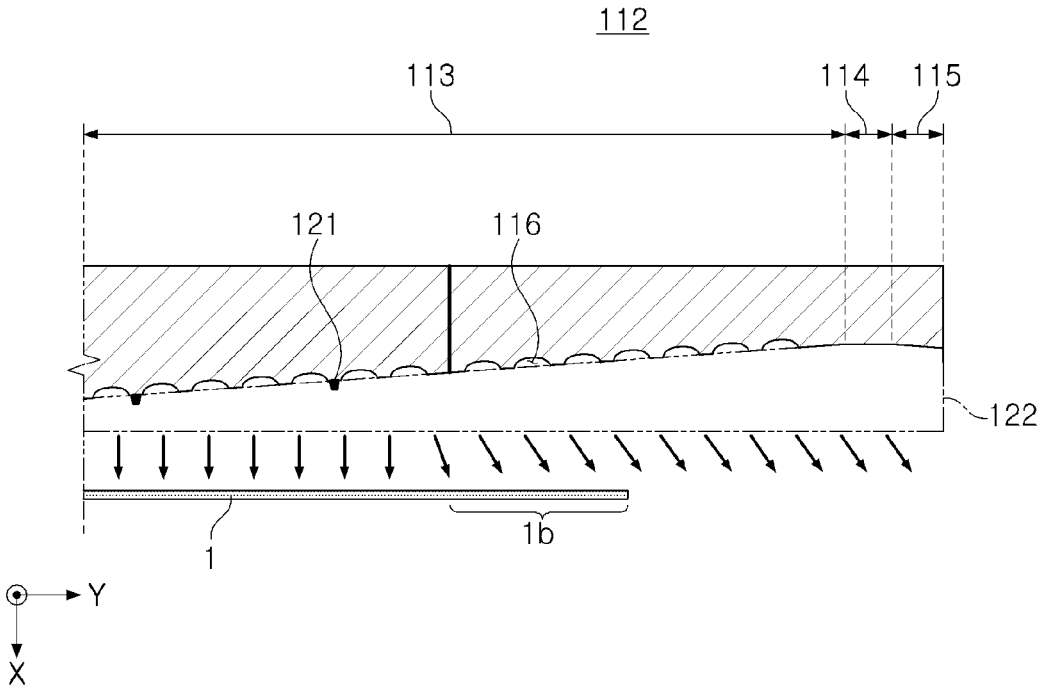
FIG. 7 is a diagram illustrating a cross-section of a second edge body to which a dimple region is applied.

As illustrated in FIG. 7, in an embodiment of the present disclosure, the second edge body 112 may include a dimple region 116 having a shape of a groove formed to be concave in a direction opposing the steel sheet.

The dimple region 116 may also be formed in the first edge body (111 in FIG. 5), and may be provided with a plurality of dimple regions 116 formed in the first edge body (111 in FIG. 5) and the second edge body 112 in a Y-axis direction.

In addition, since end potions of the first edge body (111 in FIG. 5) and the second edge body 112 extend outside an external circumference of the steel sheet 1, the dimple region 116 may be formed in the first edge body (111 in FIG. 5) and the second edge body 112 to be present to the outside of an end portion of the steel sheet.

The dimple region 116 may serve to reduce maximum shear stress generated on the surface of the steel sheet to reduce the amount of cooling fluid in the first edge portion (1*a* of FIG. 5) and the second edge portion of the steel sheet and to prevent surface defects in the first edge portion (1*a* of FIG. 5) and the second edge portion of the steel sheet.

In addition, the dimple region 116 may serve to promote formation of a turbulent boundary layer on the surfaces of the first edge body (111 in FIG. 5) and the second edge body 112.

The dimple region 116, disposed on the surfaces of the first edge body (111 in FIG. 5) and the second edge body 112 in a width direction of the steel sheet, may serve to reduce shear stress generated between the surfaces of the first edge body (111 in FIG. 5) and the second edge body 112, and the cooling fluid, and thus, may increase a flow rate of the cooling fluid to smoothly discharge the cooling fluid.

Accordingly, the cooling fluid may be smoothly and rapidly discharged in the direction of the first edge portion (1*a* of FIG. 5) and the second edge portion of the steel sheet.

Such a phenomenon may serve to suppress formation of a blowing mark, a type of defect, on the surface of the steel sheet.

Figure 9:
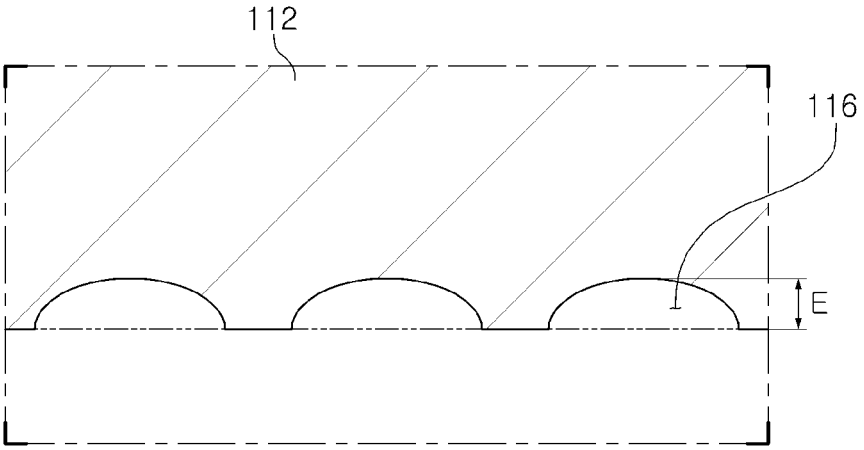
FIG. 9 is a schematic diagram of a dimple region.

As illustrated in FIGS. 8 and 9, the dimple region 116 formed in the second edge body (112 in FIG. 9) may have a diameter D which is a certain value within the range of more than 0 mm and 15 mm or less and a depth (E in FIG. 9) which is a certain value within the range of more than 0 mm to 0.5 mm or less, and a maximum value of a pitch P may be 25 mm. Such a standard may be equivalently applied to not only the second edge body (112 in FIG. 9) but also the first edge body (111 in FIG. 5).

Figure 10:
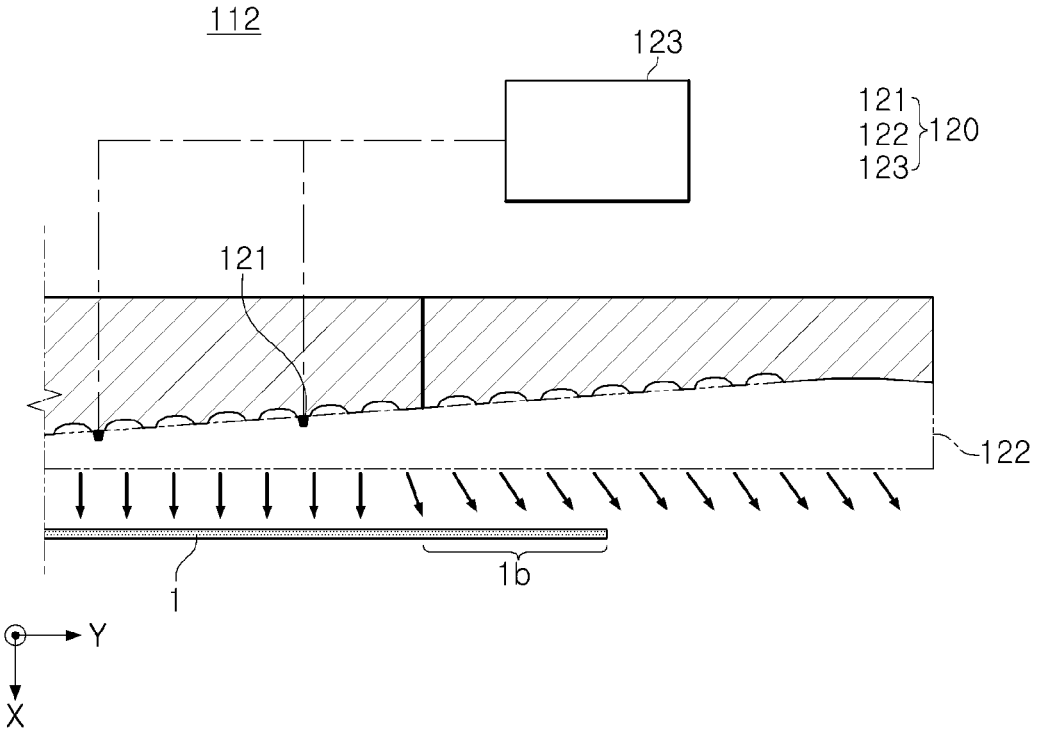
FIG. 10 is a diagram illustrating a cross-section of a second edge body according to another embodiment of the present disclosure.

As illustrated in FIG. 10, a cooling means 120 according to an embodiment of the present disclosure may include a plurality of cooling nozzles 121 facing a steel sheet and supplying a cooling fluid to a surface of the steel sheet, a slot 122 accommodating the cooling nozzles 121 therein, and a supply means 123 connected to the cooling nozzle 121 to supply the cooling fluid at a constant pressure.

The supply means 123 may adopt a supply pump, connected to each of the cooling nozzles 121 to provide a constant supply pressure, or the like. However, the type of the supply means 123 is not limited by the present disclosure.

Figure 11:
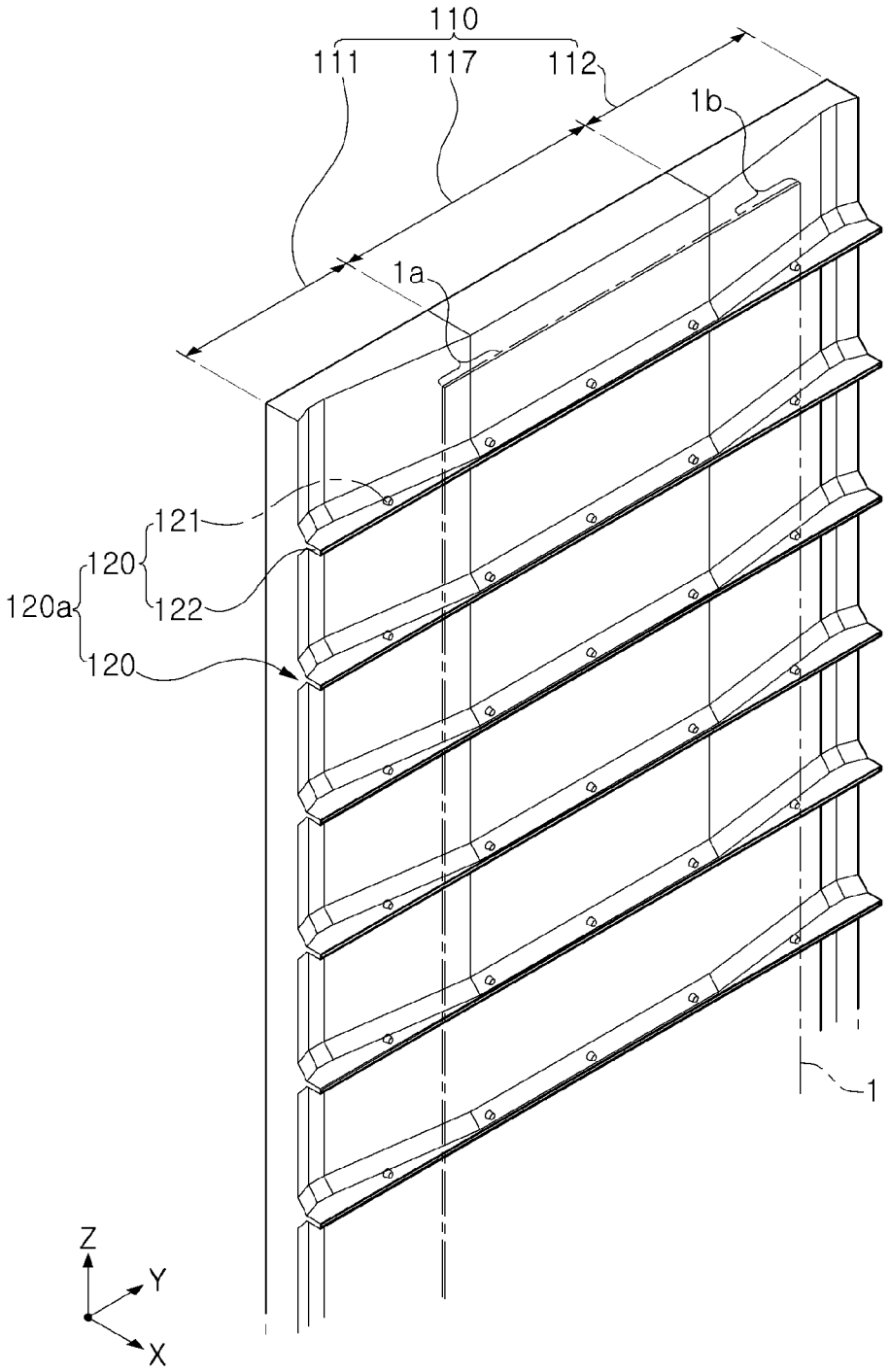
FIG. 11 is a schematic diagram of an apparatus for cooling a steel sheet according to another embodiment of the present disclosure.

An apparatus for cooling a steel sheet according to another embodiment of the present disclosure is illustrated in FIG. 11.

According to another embodiment of the present disclosure, an apparatus body may further include a center body 117 facing a center of a steel sheet in a width direction and present between the first edge body 111 and the second edge body 112.

A shortest distance from the center body 117 to the steel sheet in the X-axis direction, for example, in a thickness direction of the steel sheet, may be constantly provided in the width direction of the steel sheet. A surface of the center body 117, facing the steel sheet, may be disposed to be parallel to the surface of the steel sheet.

The center body 117 may not face a first edge portion 1*a* and a second edge portion 1*b* of the steel sheet, the first edge portion 1*a* of the steel sheet may face the first edge body 111, and the second edge portion 1*b* of the steel sheet may face the second edge body 112.

In addition, a plurality of cooling means 120 spaced apart from each other in the conveying direction of the steel sheet, for example, in a Z-axis direction, may be provided to constitute a cooling unit 120*a* on the apparatus body.

The cooling means 120 may include a plurality of cooling nozzles 121, formed in the apparatus body in a Y-axis direction, and a slot 122 accommodating the cooling nozzle 121 therein.

Figure 12:
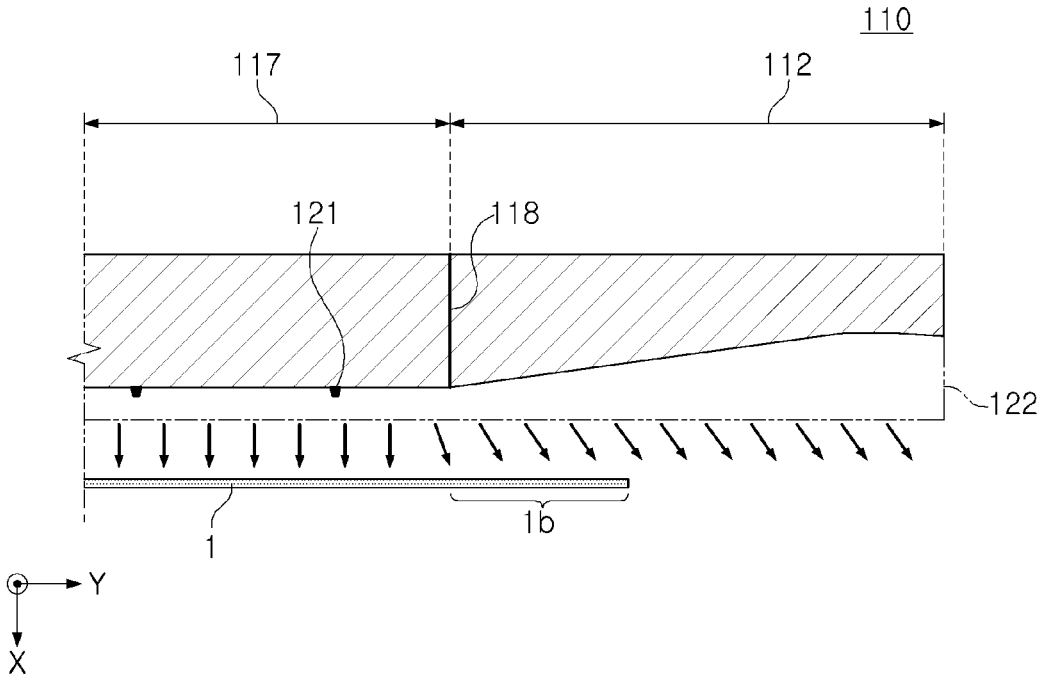
FIG. 12 is a diagram illustrating a portion of a cross-section of an apparatus body.

FIG. 12 illustrates half of the apparatus body 110, and the apparatus body 110 may have a bilaterally symmetrical structure with respect to a centerline in the X-axis direction of FIG. 12.

Therefore, it can be seen that a cross-section of the second edge body 112 in an X-Y plane, connected to half of the center body 117 and one side of the second edge body 112, is illustrated in FIG. 12. Matters concerning the edge body 112 to be described later may be equivalently applied to the first edge body (111 in FIG. 11).

The center body 117 may face a certain distance from the center of the steel sheet in the direction of the second edge portion 1*b* of the steel sheet. In addition, the second edge portion may be provided to face the second edge body of the steel sheet.

In this case, the cooling nozzle 121 may be provided only in the center body 117 to supply the cooling fluid to the steel sheet.

Figure 13:
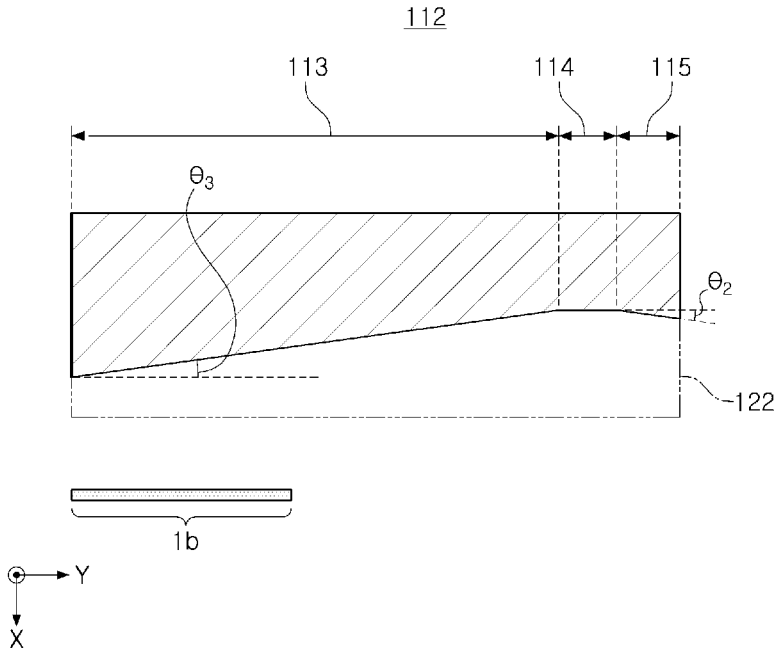
FIG. 13 is a diagram illustrating a cross-section of a second edge body.
Figure 14:
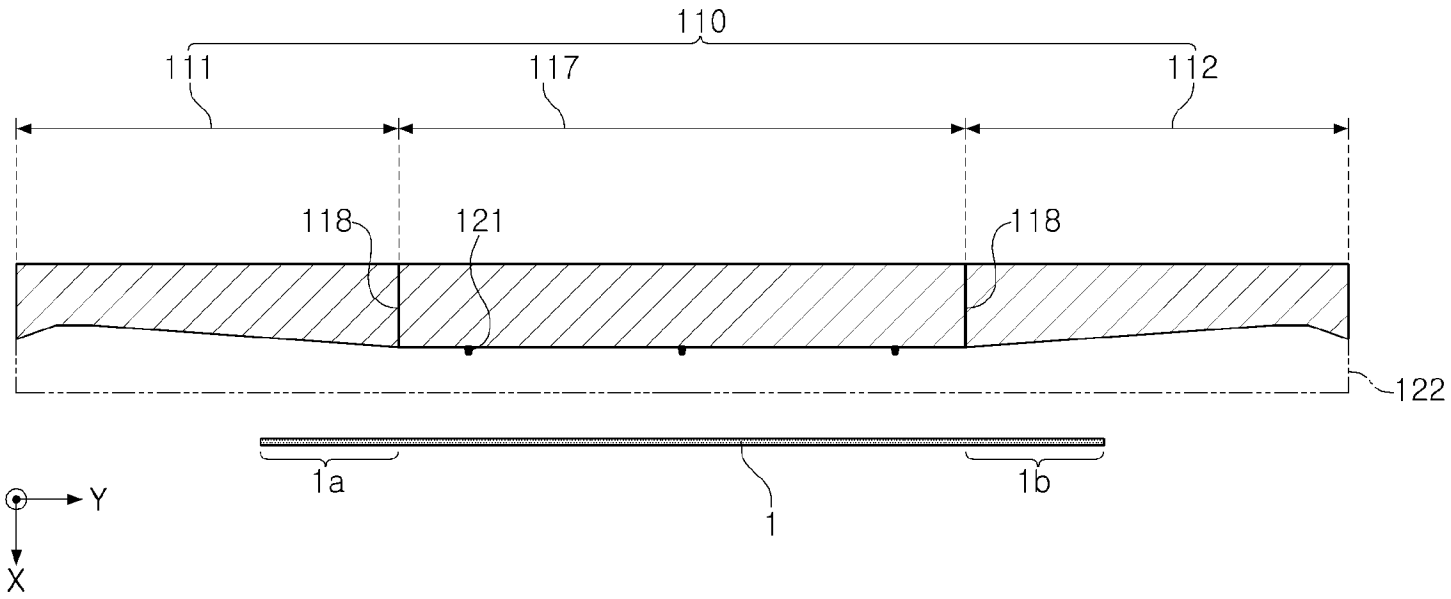
FIG. 14 is a schematic diagram illustrating cross-section of an apparatus body.

As illustrated in FIGS. 13 and 14, the second edge body 112 may include a first inclined section 113 facing the second edge portion 1*b* and formed to have an external circumference provided to be inclined in a direction away from a surface of a steel sheet, a non-inclined section 114 connected to the first inclined section 113 and formed parallel to the second edge portion 1*b* to have an external circumference provided so as not to be inclined in a Y-axis direction, and a second inclined section 115 connected to the non-inclined section 114 and formed to have an external circumference provided to be inclined in a direction toward the surface of the steel sheet.

In this case, a length of the non-inclined section 114 in the Y-axis direction may be a certain value greater than zero (0), and is less than or equal to ⅕ of a total length of the center body (117 in FIG. 11) in the width direction of the steel sheet.

In an embodiment of the present disclosure, a length of the center body (117 of FIG. 11) in a width direction of the steel sheet may be at least 450 mm, a length of the inclined section 113 in the width direction of the steel sheet may be at least 450 mm, a length of the non-inclined section 114 in the width direction of the steel sheet may be at least 50 mm, and a length of the second inclined section 115 in the width direction of the steel sheet may be at least 50 mm.

In addition, the first inclined section 113 and the second inclined section 115 may be provided to be linearly inclined.

The first inclined section 113 may be formed by being inclined in a direction away from the second edge portion such that the external circumference of the second edge member 112 and an extension line of the center body (117 of FIG. 11) forms a third inclination angle θ3.

The non-inclined section 114 may be connected from an end portion of the first inclined section 113, and the second inclined section 115 may be formed by providing the external circumference of the second edge body 112 to be inclined again in a direction toward the second edge portion from the non-inclined section 114.

The above description may be applied as the same principle to the first edge body (111 of FIG. 11) by reflecting that the first edge body (111 of FIG. 11) is symmetrical with the second edge body 112.

In this case, an absolute value of the third inclination angle θ3 may be a certain value between 1° or more and 5° or less.

For example, in another embodiment of the present disclosure, a first inclination angle (θ1 in FIG. 8) may not be present in the apparatus body 110.

One partition wall 118, separating the center body 117 and the second edge body 112 from each other, and another partition wall 118, separating the center body 117 and the first edge body 111 from each other, may be provided inside the apparatus body 111.

Accordingly, a pair of partition walls 118 may be present in the Y-axis direction inside the apparatus body (110 in FIG. 11), and a distance between the partition walls 118 may be equal to an overall length of the center body 117 in the Y-axis direction.

This may serve to prevent injection pressure of a cooling fluid from being unnecessarily dispersed in the apparatus body (110 in FIG. 11) when the injection pressure is provided to the cooling nozzle 121.

In addition, a length of the second inclined section 115 in the Y-axis direction may be greater than zero (0) and may be a certain value within the range less than or equal to the length of the non-inclined section 114 in the Y-axis direction.

Accordingly, the length of the second inclined section 115 in the Y-axis direction may be less than or equal to the length of the non-inclined section 114 in the Y-axis direction.

Figure 15:
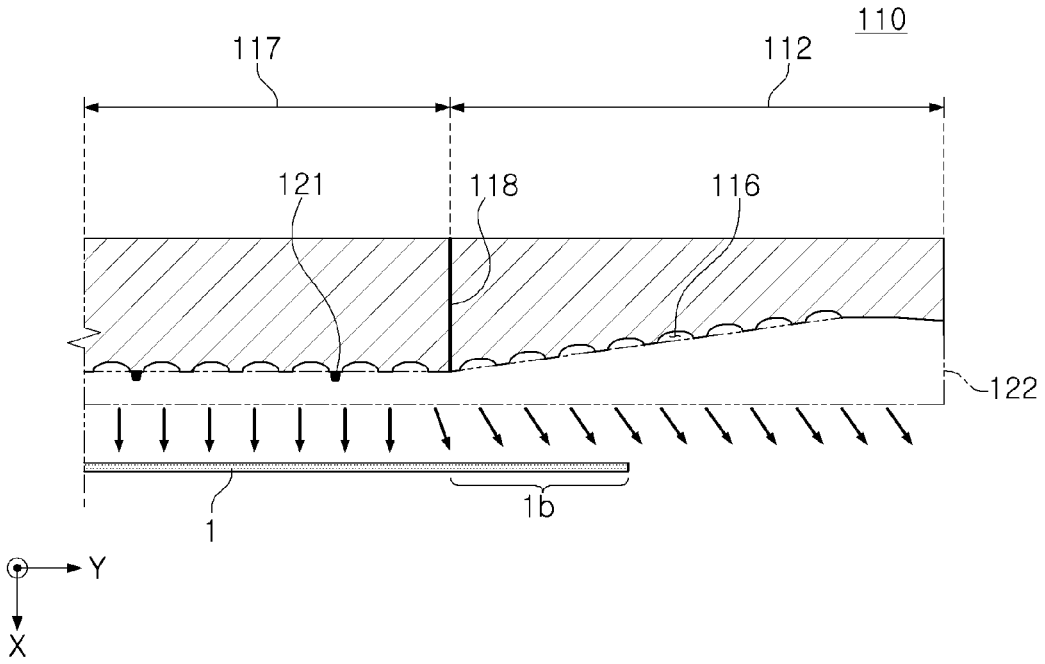
FIG. 15 is a diagram illustrating a portion of a cross-section of an apparatus body to which a dimple region according to another embodiment of the present disclosure is applied.

In addition, as illustrated in FIG. 15, the dimple region 116 may also be formed in the center body 117 and the second edge body 112.

The dimple region 116 may be provided with a plurality of dimple regions 116 provided on the apparatus body (110 in FIG. 14) in the Y-axis direction, and details thereof may be applied in the same manner as those of the above-described dimple region 116.

Figure 16:
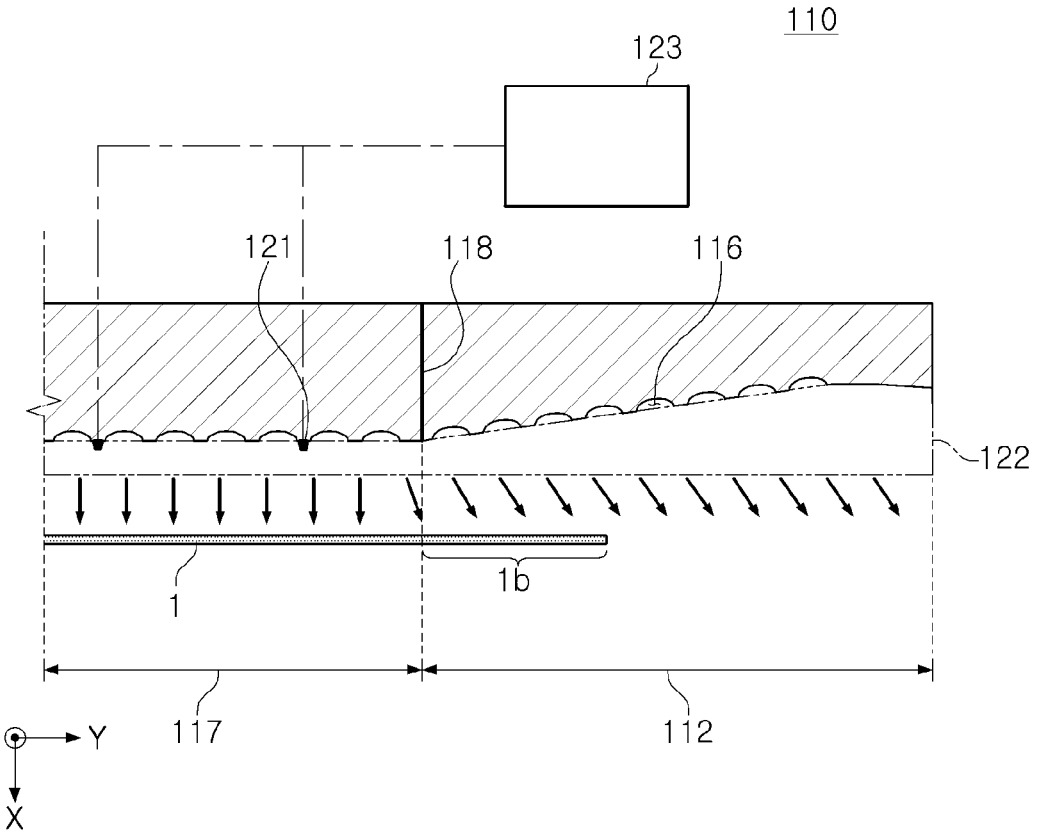
FIG. 16 is a diagram illustrating a portion of a cross-section of an apparatus body to which a dimple region according to another embodiment of the present disclosure is applied.

In addition, as illustrated in FIG. 16, the supply means 123 may also be connected to the cooling nozzle 121 provided in the center body 117.

The supply means may be provided as a supply pump, providing supply pressure of the cooling fluid, or the like, but is not limited by the present disclosure.

In addition, the cooling nozzle 121 may supply a cooling fluid to the steel sheet while being disposed to be closer to the surface of the steel sheet 1 than the external circumference of the center body 117 in the X-axis direction.

In this case, an opened supply hole of the slot 122 accommodating the cooling nozzle 121 therein may be disposed to be closer to the surface of the steel sheet in the X-axis direction than the cooling nozzle 121.

Accordingly, loss of the supply pressure of the cooling fluid and the amount of loss of the cooling fluid may be reduced.

In addition, the plurality of cooling nozzles 121 may be spaced apart from the surface of the steel sheet at regular intervals in the X-axis direction to uniformly supply the cooling fluid.

Figures 17, 18:
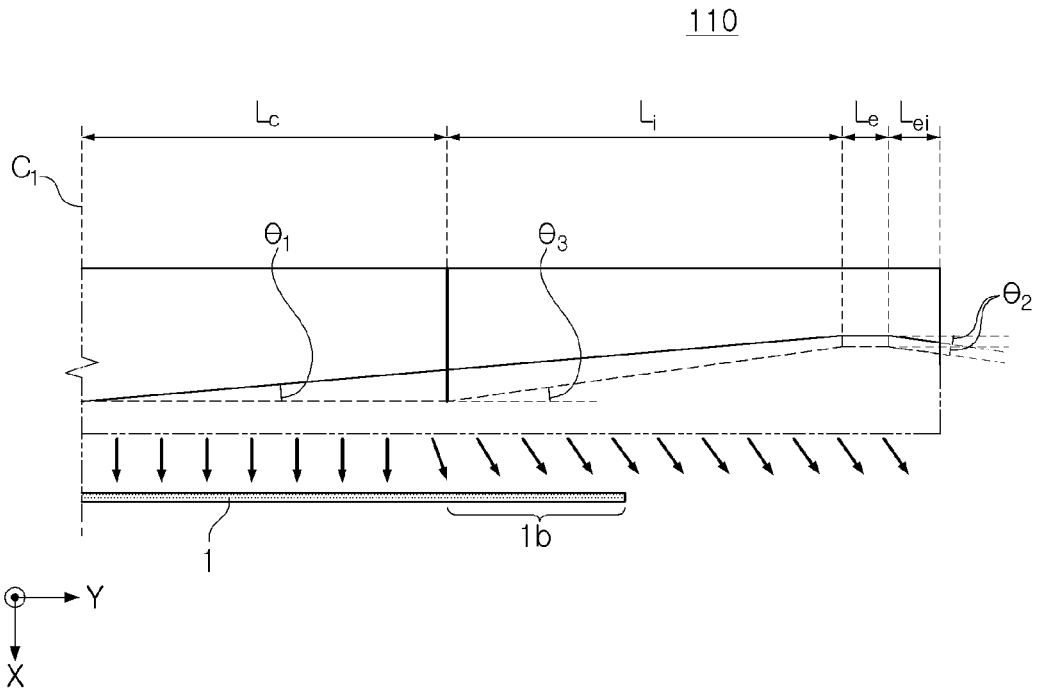
FIG. 17 is a diagram illustrating a portion of an apparatus body.
FIG. 18 is a diagram illustrating the standard of the apparatus body of FIG. 17 for each case.

The apparatus body 110 illustrated in FIG. 17 may have a bilaterally symmetrical structure with respect to a center line C1. In FIG. 17, only a right region of the apparatus body 110 is illustrated for convenience of drawing.

Hereinafter, a description will be provided by dividing the apparatus body 110 in half in the Y-axis direction according to a first section Lc, a second section Li, a third section Le, and a fourth section Lei.

In this case, a boundary between the first section Lc and the second section Li may be a partition wall (118 in FIG. 15), and the first section Lc may be a region corresponding to the center body (117 in FIG. 15).

FIG. 18 illustrates a total of eight cases to which values the first section Lc, the second section Li, the third section Le, and the fourth section Lei and first, second, and third inclination angles θ1, θ2, and θ3 was applied.

Figure 19:
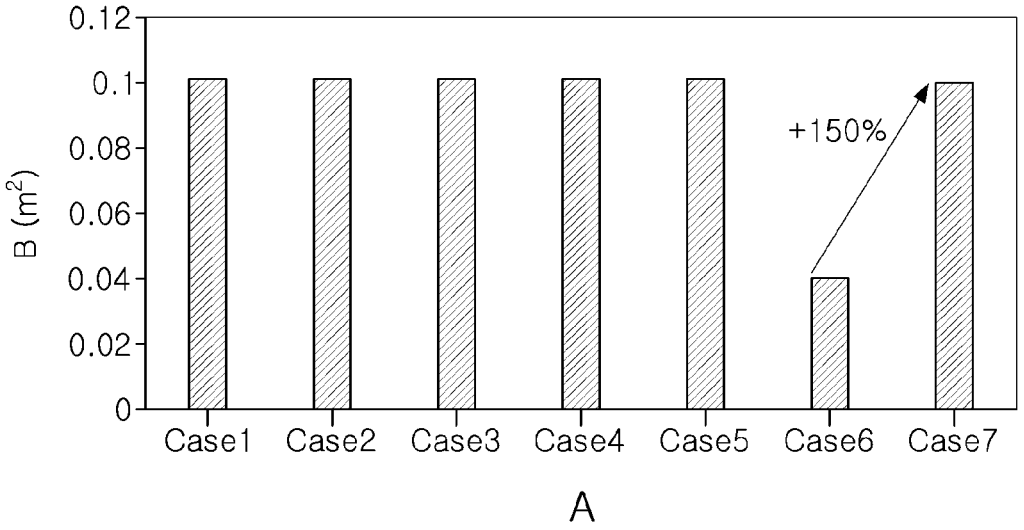
FIG. 19 is a diagram illustrating an area of a cooling fluid discharge space according to FIG. 18.

FIG. 19 illustrates a region B of a cooling fluid discharge space of the apparatus body (110 in FIG. 16) for each case by applying seven cases, among eight cases, as Embodiment A.

Figure 20:
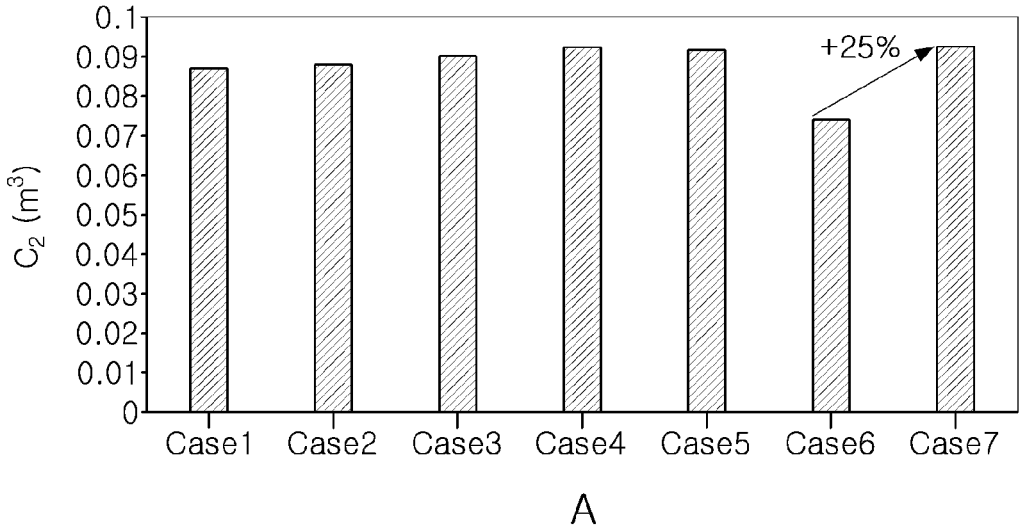
FIG. 20 is a diagram illustrating a volume of a space formed between a surface of an apparatus body and a surface of the steel sheet according to FIG. 18
Figure 21:
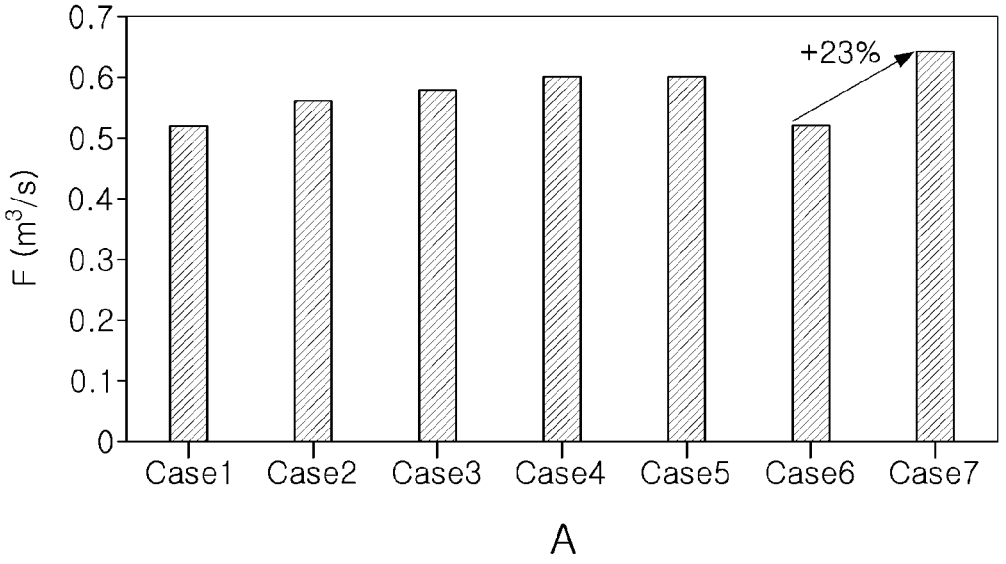
FIG. 21 is a diagram illustrating a cooling fluid flow rate according to FIG. 18
Figure 22:
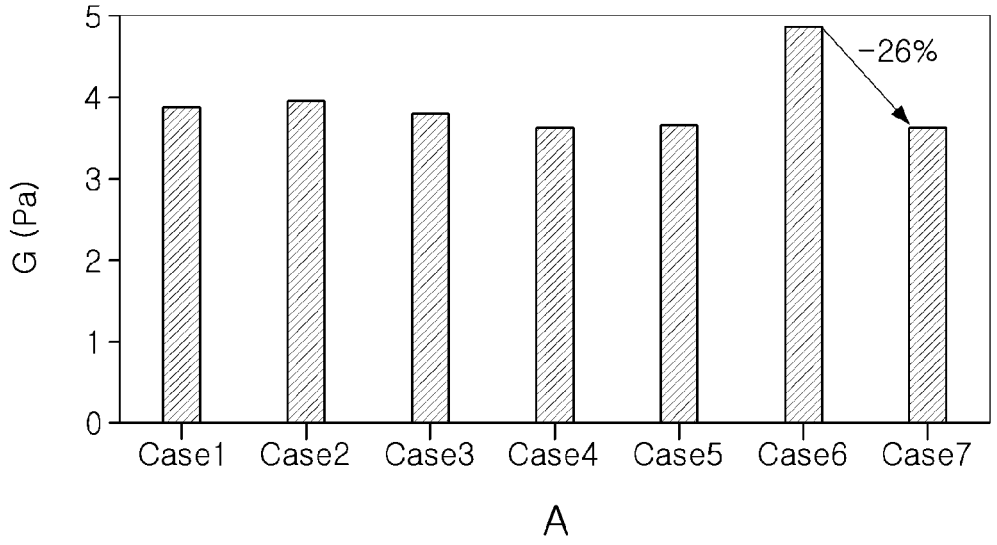
FIG. 22 is a diagram maximum shear stress of a steel sheet in a cooling fluid discharge direction according to FIG. 18.
Figure 23:
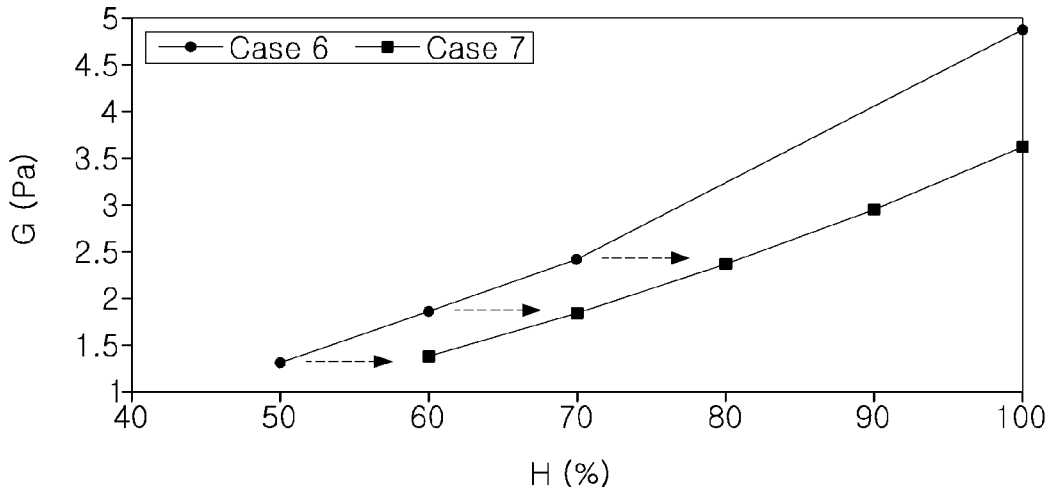
FIG. 23 is a diagram illustrating maximum shear stress on a surface of a steel sheet in a cooling fluid discharge direction depending on a cooling fluid supply pressure of Cases 6 and 7.

In addition, FIG. 20 illustrates a volume C2 of a space formed between a surface of the apparatus body (110 in FIG. 17) and a surface of the steel sheet (1 in FIG. 17) for each case by applying the seven cases of FIG. 18 as Embodiment A. FIG. 21 illustrates a cooling flow rate F for each case by applying the seven cases of FIG. 18 as Embodiment A, FIG. 22 illustrates maximum shear stress G on a surface of a steel sheet in a discharge direction of a cooling fluid for each case by applying the seven cases of FIG. 18 as Embodiment A, and FIG. 23 illustrates maximum shear stress G on a surface of a steel sheet in a discharge direction of a cooling fluid depending on supply pressure of supplying an output H, for example, a cooling fluid, of the supply means (123 of FIG. 10 and 123 of FIG. 16) for supplying the cooling fluid from the apparatus body (110 of FIG. 17) at regular pressure when Case 6 and Case 7 of FIG. 23 are applied.

As can be seen from results of FIG. 19, an area B of a cooling fluid discharge space in each of Cases 1 to 5 and Case 7 was about 150% wider than that of Case 6.

As can be seen from results of FIG. 20, a volume C2 of a space formed between the surface of the apparatus body (110 in FIG. 17) and the surface of the steel sheet (1 in FIG. 17) was about 25% larger than that of each of Case 6 and Cases 1 to 5.

As can be seen from results of FIG. 21, a cooling flow rate F of each of Cases 1 to 5 and Case 7 was increased by about 23% as compared with Case 6, and thus, cooling efficiency was improved.

As can be seen from results of FIG. 22, maximum shear stress G on the surface of the steel sheet was decreased by about 26% in the discharge direction of the cooling fluid in Cases 1 to 5 and Case 6, as compared with Case 6.

Referring to FIG. 23, even in Case 7 in which the output H of the supply means (123 in FIGS. 10 and 123 in FIG. 16) for supplying the cooling fluid was increased as compared with case 6, maximum shear stress G on the surface of the steel sheet was not increased as compared with Case 6, and thus, in Case 7, even when a flow rate of the cooling fluid was increased, the maximum shear stress G on the surface of the steel sheet was not increased. As a result, occurrence of defects on the surface was suppressed while improving steel sheet cooling efficiency.

Figure 24:
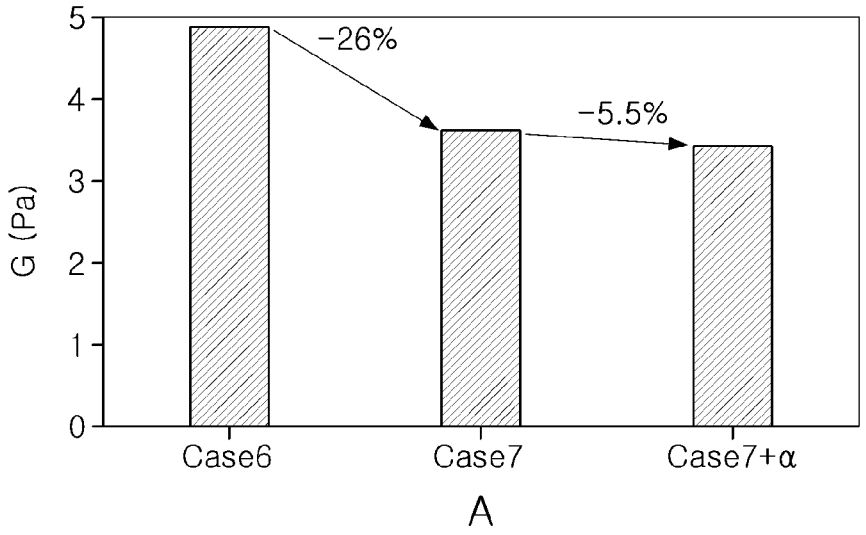
FIG. 24 is a diagram illustrating maximum shear stress on a surface of a steel sheet in a cooling fluid discharge direction according to the coolant supply pressure when a dimple region is applied to Case 6, when a dimple region is applied to Case 7, and when a dimple region is applied to both Case 6 and Case 7.

In addition, as can seen in FIG. 24, maximum shear stress G on the surface of the steel sheet in the discharge direction of the cooling fluid was also decreased by 26% in Embodiment A of Case 7, as compared with Embodiment A of Case 6. In the case of an embodiment (Case 7+α) in which a dimple region a (116 in FIG. 8) was added to an embodiment of Case 7, maximum shear stress G on the surface of the steel sheet in the discharge direction of the cooling fluid was reduced by about 5.5% as compared with Embodiment A of Case 7.

Therefore, using such values, the standard of an apparatus body (110 in FIG. 17) of an apparatus for cooling a steel sheet may be selected according to characteristics of each steel sheet and characteristics of processes.

The above-described apparatus for cooling a steel sheet according to the present disclosure may significantly reduce surface defects of the steel sheet during manufacturing of a hot-dip magnesium-aluminum alloy-plated steel sheet and a hot-dip aluminum-plated steel sheet having excellent corrosion resistance.

While this disclosure includes specific examples, it will be apparent after an understanding of the disclosure of this application that various changes in forms and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

The invention claimed is:

1. An apparatus for cooling a steel sheet, the apparatus comprising:

an apparatus body provided to be spaced apart from the steel sheet in a conveying path of the steel sheet; and a cooling unit provided in the apparatus body to supply a cooling fluid, wherein the apparatus body comprises:

a first edge body facing a first edge portion extending a predetermined distance from one side end in a width direction of the steel sheet to a center in the width direction of the steel sheet; and a second edge body facing a second edge portion extending a predetermined distance from the other side end in the width direction of the steel sheet to the center in the width direction of the steel sheet, wherein the apparatus body has a first inclination angle formed between an extension line of a symmetry point at which the first edge body and the second edge body intersect each other and the first and second edge bodies, and wherein each of the first and second edge bodies comprises:

a first inclined section forming the first inclination angle together with the extension line and being a region inclined in a direction away from the steel sheet;

a non-inclined section, connected to the first inclined section, from which a shortest distance to the steel sheet in a thickness direction of the steel sheet is provided to be constant; and a second inclined section connected to the non-inclined section and being a region inclined in a direction toward the steel sheet.

2. The apparatus of claim 1, wherein in the apparatus body, an absolute value of the first inclination angle is 1° or more to 10° or less.

3. The apparatus of claim 2, wherein the apparatus body further comprises:

a center body facing a center in a width direction of the steel sheet and present between the first edge body and the second edge body, and wherein the center body is provided such that a shortest distance to the steel sheet in the thickness direction of the steel sheet is provided to be constant in the width direction the steel sheet.

4. An apparatus for cooling a steel sheet, the apparatus comprising:

an apparatus body provided to be spaced apart from the steel sheet in a conveying path of the steel sheet; and a cooling unit provided in the apparatus body to supply a cooling fluid, wherein the apparatus body comprises:

a first edge body facing a first edge portion extending a predetermined distance from one side end in a width direction of the steel sheet to a center in the width direction of the steel sheet; and a second edge body facing a second edge portion extending a predetermined distance from the other side end in the width direction of the steel sheet to the center in the width direction of the steel sheet, wherein each of the first and second edge bodies is provided such that a cross-section in a direction, perpendicular to a conveying direction of the steel sheet, is linearly inclined, and end portions of the first and second edge bodies are inclined in a direction away from the steel sheet to be present farthest from the steel sheet, wherein the apparatus body has a first inclination angle formed between an extension line of a symmetry point at which the first edge body and the second edge body intersect each other and the first and second edge bodies, and wherein each of the first and second edge bodies comprises:

a first inclined section forming the first inclination angle together with the extension line and being a region inclined in a direction away from the steel sheet;

a non-inclined section, connected to the first inclined section, from which a shortest distance to the steel sheet in a thickness direction of the steel sheet is provided to be constant; and a second inclined section connected to the non-inclined section and being a region inclined in a direction toward the steel sheet.

5. The apparatus of claim 4, wherein the first and second edge bodies are provided to form a second inclination angle in the second inclined section together with the extension line of the non-inclined section in the width direction of the steel sheet, and wherein an absolute value of the second inclination angle is at least 3°.

6. The apparatus of claim 5, wherein a length of the first inclined section in the width direction of the steel sheet is at least 900 mm, a length of the non-inclined section in the width direction of the steel sheet is at least 50 mm, and a length of the second inclined section in the width direction of the steel sheet is at least 50 mm.

7. The apparatus of claim 4, wherein the apparatus body comprises:

at least one dimple region formed to be concave on a surface, facing the steel sheet, in a direction opposing the steel sheet.

8. The apparatus of claim 7, wherein the first edge body and the second edge body extend outwardly of an external surface of the steel sheet in the width direction of the steel sheet.

9. The apparatus of claim 8, wherein the first and second edge bodies are symmetrical with each other in the width direction of the steel sheet with respect to the symmetry point at which the first edge body and the second edge body intersect each other.

10. The apparatus of claim 9, wherein a diameter of the dimple region is a value greater than 0 mm to 15 mm or less, a depth of the dimple region is a value greater than 0 mm to 0.5 mm or less, and a maximum pitch of the dimple region is 25 mm.

11. The apparatus of claim 10, wherein the cooling unit comprises:

a plurality of cooling means spaced apart from each other in the conveying direction of the steel sheet in the apparatus body, and wherein the cooling means comprises:

a plurality of cooling nozzles facing the steel sheet to supply a cooling fluid;

a slot accommodating the cooling nozzles therein; and a supply means connected to the cooling nozzles to supply the cooling fluid at constant pressure.

12. The apparatus of claim 11, wherein the cooling unit comprises a plurality of cooling means spaced apart from each other in the conveying direction of the steel sheet in the apparatus body, wherein the cooling means comprises:

a plurality of cooling nozzles facing the steel sheet to supply a cooling fluid;

a slot accommodating the cooling nozzles therein; and a supply means connected to the cooling nozzles to supply the cooling fluid at constant pressure, and wherein the plurality of cooling nozzles are provided with a plurality of cooling nozzles in the width direction of the steel sheet in the apparatus body, and are provided in the apparatus body to supply the cooling fluid in a position closer to the steel sheet than an external surface of the apparatus body, and wherein the plurality of cooling nozzles are spaced apart from the steel sheet at regular intervals in the thickness direction of the steel sheet.

13. An apparatus for cooling a steel sheet, the apparatus comprising:

an apparatus body provided to be spaced apart from the steel sheet in a conveying path of the steel sheet; and a cooling unit provided in the apparatus body to supply a cooling fluid, wherein the apparatus body comprises:

a first edge body facing a first edge portion extending a predetermined distance from one side end in a width direction of the steel sheet to a center in the width direction of the steel sheet; and a second edge body facing a second edge portion extending a predetermined distance from the other side end in the width direction of the steel sheet to the center in the width direction of the steel sheet; and a center body facing a center in a width direction of the steel sheet and present between the first edge body and the second edge body, wherein the center body is provided such that a shortest distance to the steel sheet in a thickness direction of the steel sheet is provided to be constant in the width direction the steel sheet, wherein each of the first edge body and the second edge body comprises:

a first inclined section facing the edge portion of the steel sheet and formed by providing an external surface of the first inclined section so as to be inclined in a direction away from a surface of the steel sheet;

a non-inclined section connected to the first inclined section and formed by providing an external surface of the non-inclined section so as not to be inclined; and a second inclined section connected to the non-inclined section and formed by providing an external surface of the second inclined section so as to be inclined in a direction toward the surface of the steel sheet, wherein a length of the non-inclined section in the width direction of the steel sheet is greater than 0 and is a value less than or equal to ⅕ of a total length of the center body in the width direction of the steel sheet, and wherein the first and second inclined sections are provided to be linearly inclined.

14. The apparatus of claim 13, wherein the apparatus body comprises:

a plurality of partition walls disposed to be spaced apart from each other in the width direction of the steel sheet inside the apparatus body, and wherein a spacing distance between the plurality of partition walls is at least equal to a length of the center body in the width direction of the steel sheet.

15. The apparatus of claim 13, wherein an absolute value of a third inclination angle, formed between an extension line of the center body and the first inclined section, is a value between 1° or more to 5° or less.

16. The apparatus of claim 13, wherein a length of the second inclined section in the width direction of the steel sheet is greater than 0, and is a certain value within a range less than or equal to a length of the non-inclined section in the width direction of the steel sheet.

17. The apparatus of claim 16, wherein an absolute value of a second inclination angle, formed between an extension line of the non-inclined section in the width direction of the steel sheet and the second inclined section, is greater than 0° and is a value less than or equal to an absolute value of an inclination angle of the first inclined section.

18. The apparatus of claim 17, wherein the apparatus body comprises a plurality of dimple regions formed to be concave on a surface, facing the steel sheet, in a direction opposing the steel sheet, and wherein the plurality of dimple regions are disposed in the width direction of the steel sheet.

* * * * *